US006036033A

United States Patent [19]

Chang

[11] Patent Number: 6,036,033

[45] Date of Patent: Mar. 14, 2000

[54] CONSTRUCTION ASSEMBLY HAVING A QUICK COUPLER

[76] Inventor: Che Hao Chang, P.O. Box 63-99, Taichung, Taiwan, 406

[21] Appl. No.: 09/244,661

[22] Filed: Feb. 4, 1999

[51] Int. Cl.[7] ..... A47F 5/14; A47B 43/00; A47B 9/00

[52] U.S. Cl. ..... 211/182; 211/187; 108/107; 108/147.15; 108/147.13

[58] Field of Search ..... 211/182, 189, 211/206, 187; 108/106, 107, 108, 147.12, 147.13, 147.15, 147.16

[56] References Cited

U.S. PATENT DOCUMENTS 3,757,705 9/1973 Maslow ..... 108/147.13

5,127,342 7/1992 Taylor ..... 211/187 X

*Primary Examiner*—Daniel P. Stodola
*Assistant Examiner*—Erica B. Harris

[57] ABSTRACT

A construction device includes a rack secured to one or more rods with one or more couplers. Each coupler includes a bore for receiving the rod, a base portion, a wall extended upward from the base portion and a panel extended downward from the base portion. The bottom portions of the panels are inclined relative to the wall for engaging with the rods and for securing the couplers to the rods. The couplers may further include one or more protrusions for engaging with the grooves formed in the rods and for further securing the coupler to the rod.

7 Claims, 4 Drawing Sheets

CONSTRUCTION ASSEMBLY HAVING A QUICK COUPLER

BACKGROUND OF THE INVENTION

1. Field of the Invention

The present invention relates to a construction assembly, and more particularly to a construction assembly having a quick coupler.

2. Description of the Prior Art

Typical construction assemblies or furniture constructions or racks comprise a number of panels or plates secured together by a number of coupling mechanisms which normally include a complicated configuration that may not be easily assembled.

The present invention has arisen to mitigate and/or obviate the afore-described disadvantages of the conventional construction assemblies.

SUMMARY OF THE INVENTION

The primary objective of the present invention is to provide a construction assembly having a quick coupler for allowing the construction assembly to be easily and quickly assembled or disassembled.

In accordance with one aspect of the invention, there is provided a construction assembly comprising at least one rod; a rack; and at least one coupler secured to the rack including a bore formed therein for receiving the rod, a base portion, a wall extended upward from the base portion of the coupler, a panel extended downward from the base portion of the coupler, the panel including a bottom portion and being inclined relative to the wall for allowing the bottom portion of the panel to be engaged with the rod and to secure the coupler to the rod.

The rod includes a plurality of grooves formed therein, the coupler includes at least one protrusion extended inward of the bore thereof for engaging with the grooves of the rod and for securing the coupler to the rod.

The rack may be secured, with a single coupler, to a single rod that is engaged in a corner of a building. The rack may also be secured to two rods with two couplers that are solidly secured to the rack. The rack may also be engaged on and supported by three couplers.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
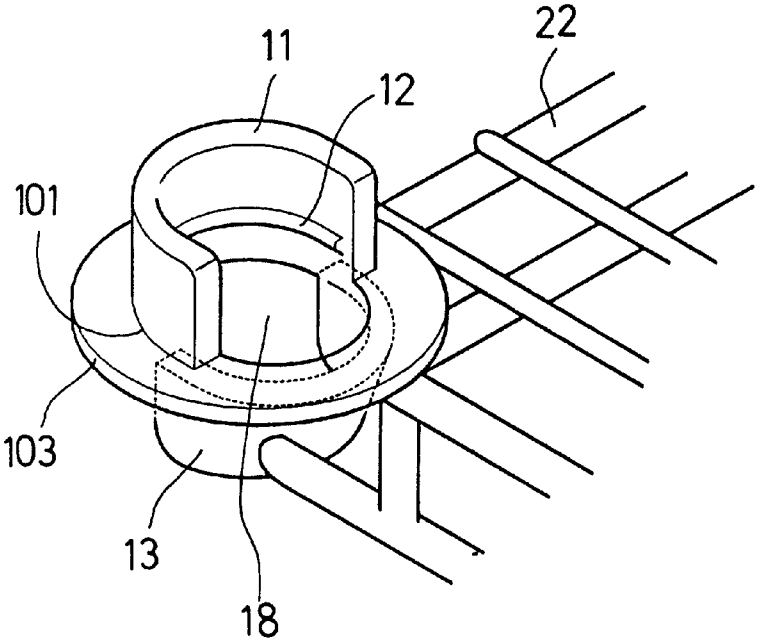
FIG. 1 is a partial perspective view of a coupling mechanism for a construction assembly in accordance with the present invention.
Figure 2:
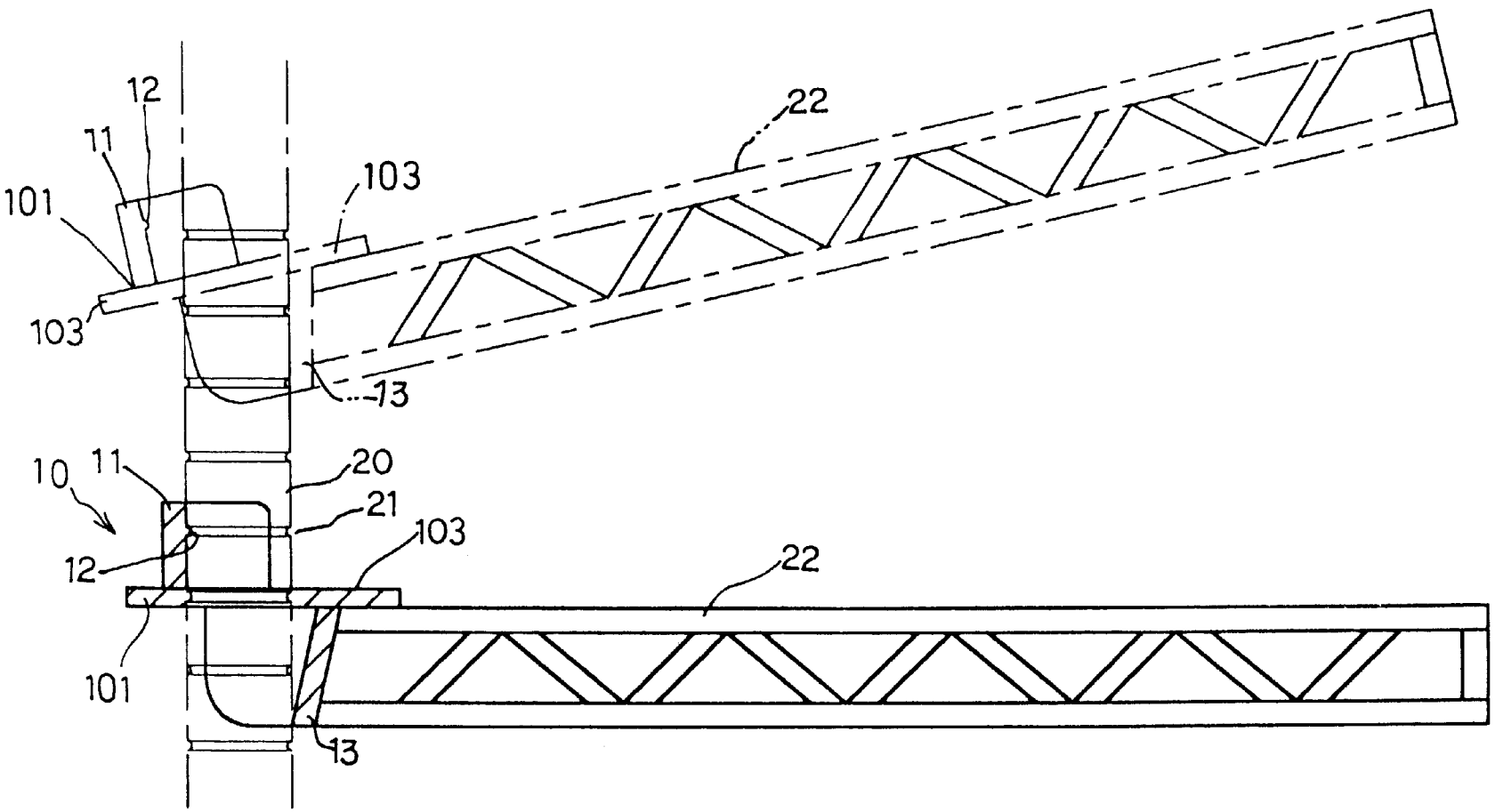
FIG. 2 is a partial cross sectional view illustrating the operation of the construction assembly.
Figure 3:
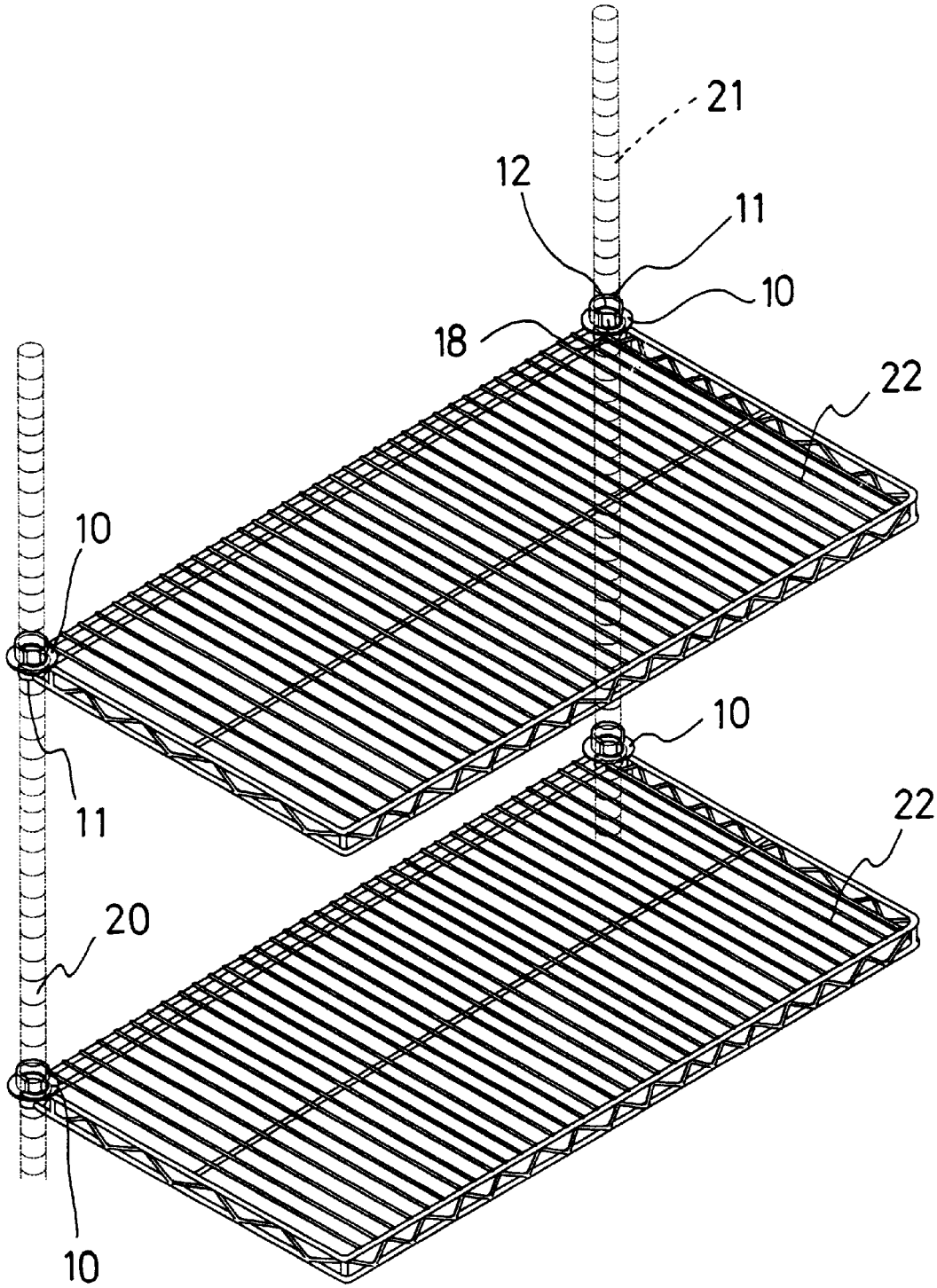
FIG. 3 is a partial perspective view of the construction assembly.

Referring initially to FIGS. 1–3, a construction assembly in accordance with the present invention comprises one or more rods 20 each having a number of cavities or annular grooves 21 formed therein, and one or more racks 22 attached to the rods 20 by one or more couplers 10. Each coupler 10 includes a curved wall 11 extended upward from a base portion 101 (such as a circular base portion) of the coupler 10, and each includes a curved panels 13 extended downward from the base portion 101 of the coupler 10, and each includes a bore 18 formed therein for receiving the rod 20. Each coupler 10 each includes one or more ribs or protrusions 12 extended inward of the bore 18 for engaging with the grooves 21 of the rod 20 and for securing the coupler 10 to the rod 20, best shown in solid lines in FIG. 2.

As best shown in FIG. 2, the panel 13 is inclined relative to the wall 11 for allowing the protrusion 12 of the coupler 10 to be disengaged from the rod 20 and for allowing the coupler 10 to be engaged onto the rod 20. The rack 22 may be secured to the coupler 10 by a welding process or by a molding process and may apply a force to the coupler 10 for actuating the protrusion 12 of the coupler 10 to engage with the groove 21 of the rod 20 and for securing the coupler 10 and the rack 22 to the rod 20, as shown in solid lines in FIG. 2. As shown in FIG. 3, the racks 22 mav each be attached to two of the rods 20 with two couplers 10.

The bottom peripheral portion of the panel 13 may also engage with the rod 20, or with a groove 21 of the rod, for further solidly securing the coupler 10 to the rod 20. It is to be noted that, without the protrusions 12 and the grooves 21 of the rods 20, the engagement of the bottom peripheral portion of the panel 13 with the rod 20 is good enough to secure the coupler 10 to the rod 20, because of the weight of the rack 22. The bores 18 of the couplers 10 and the rods 20 may include various kinds of cross sections, such as circular, square, rectangular or oval shaped cross sections. One of the racks 22 may be secured to a single rod 20 that is engaged in the corner of a building, and may include two adjacent sides engaged with the walls such that the rack 22 may also be secured to a single rod 20 with a single coupler 10.

Figure 4:
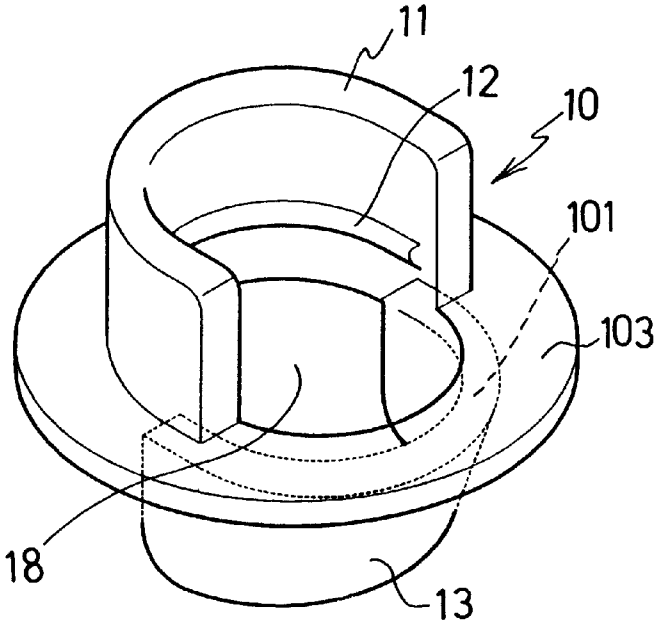
FIG. 4 is a perspective view illustrating the other application of the coupling mechanism or the coupler for the construction assembly.
Figure 5:
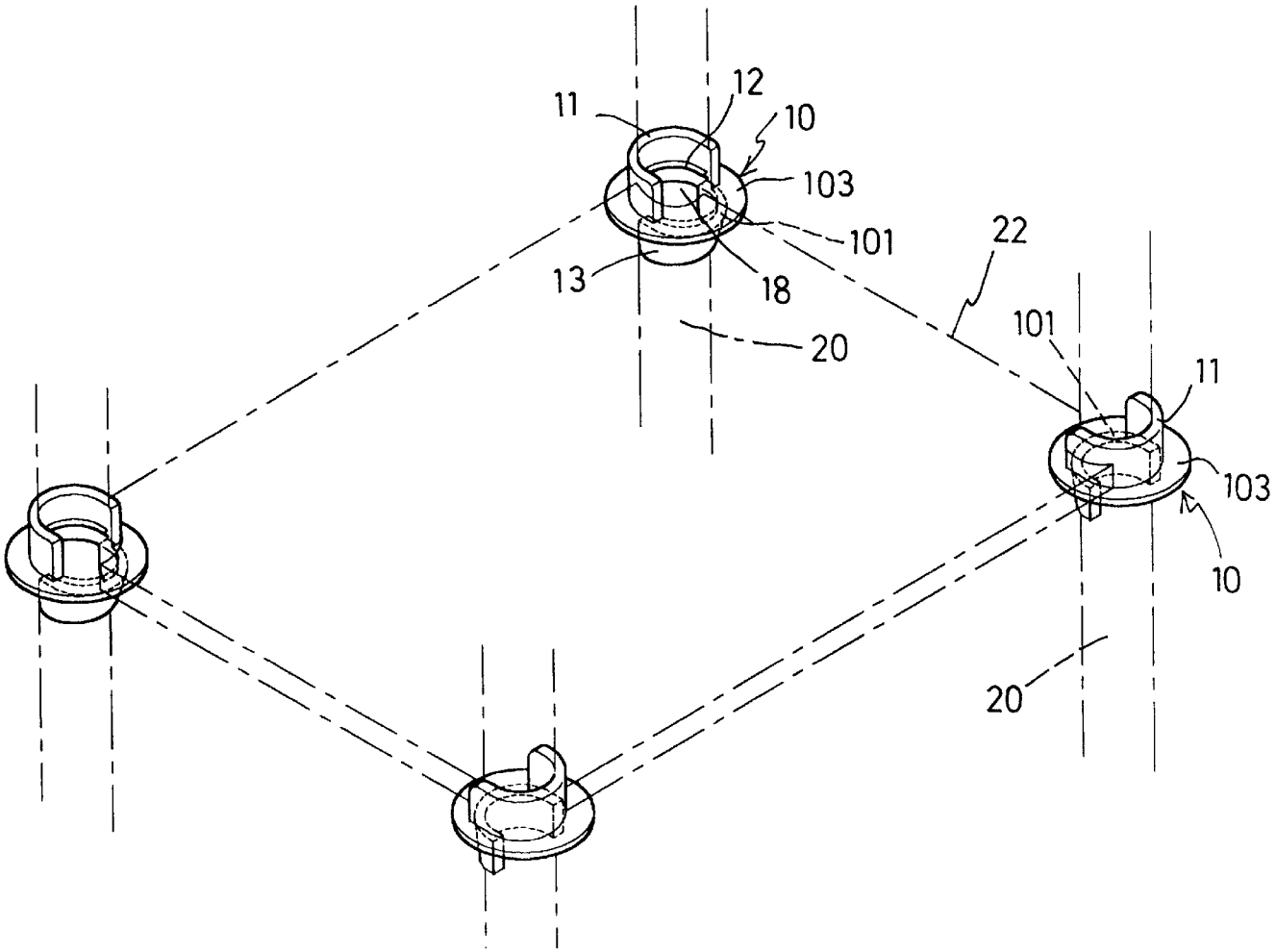
FIG. 5 is a partial cross sectional view similar to FIG. 2, illustrating the other application of the construction assembly.

Referring next to FIGS. 4 and 5, the rack 22 may be separated from the couplers 10 and may be engaged on the couplers 10, such as engaged on the base portions of the couplers, such that the rack 22 may also be supported in place by the couplers 10. It is preferable that each coupler 10 includes a flange or a peripheral flange 103 extending radially outward therefrom for engaging with and for supporting the rack 22 in place. The rack 22 may include one side supported on two of the couplers and may include the other side supported in place by the other supporting members or walls. The rack 22 may also be supported in place by three couplers 10 that are attached onto three rods 20 respectively.

Accordingly, the construction assembly in accordance with the present invention includes one or more quick couplers for allowing the construction assembly to be easily and quickly assembled or disassembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A construction assembly comprising:

at least one rod;

a rack; and at least one coupler secured to said rack and including a bore formed therein for receiving said at least one rod; a base portion, a wall extended upward from said base portion and a panel extended downward from said base portion, said panel including a bottom portion inclined relative to said wall for allowing said bottom portion of said panel to be engaged with said at least one rod and to secure said at least one coupler to said at least one rod.

2. The construction assembly according to claim 1, wherein said at least one rod includes a plurality of grooves formed therein, said at least one coupler includes at least one protrusion extended inward of said bore thereof for engaging with said grooves of said at least one rod and for securing said at least one coupler to said at least one rod.

3. A construction assembly comprising:

at least two rods;

a rack; and at least two couplers secured to said rack, each including a bore formed therein for receiving one of said at least two rods respectively, a base portion, a wall extended upward from said base portion, and a panel extended downward from said base portion, said panel including a bottom portion inclined relative to said wall for allowing said bottom portion of said panel to be engaged with said one of said at least two rods, respectively, and to secure said at least two couplers to said at least two rods.

4. The construction assembly according to claim 3, wherein said at least two rods each includes a plurality of grooves formed therein, said at least two couplers each includes at least one protrusion extended inward of said bore thereof for engaging with said grooves of said at least two rods and for securing said at least two couplers to said at least two rods.

5. A construction assembly comprising:

at least three rods;

at least three couplers each including a bore formed therein for receiving one of said at least three rods respectively, a base portion, a wall extended upward from said base portion, and a panel extended downward from said base portion, said panel including a bottom portion inclined relative to said wall for allowing said bottom portion of said panel to be engaged with said one of said at least three rods, respectively, and to secure said at least three couplers to said at least three rods; and a rack engaged on and supported in place by said at least three couplers.

6. The construction assembly according to claim 5, wherein said at least three rods each includes a plurality of grooves formed therein, said at least three couplers each includes at least one protrusion extended inward of said bore thereof for engaging with said grooves of said at least three rods and for securing said at least three couplers to said at least three rods.

7. The construction assembly according to claim 5, wherein said at least three couplers each includes a flange extended outward therefrom for engaging with and for supporting said rack in place.

* * * * *